United States Patent [19]

Shirao

[11] Patent Number: 4,589,819

[45] Date of Patent: May 20, 1986

[54] WORKPIECE LOADING/UNLOADING DEVICE FOR A PRESS OR THE LIKE

[75] Inventor: Shojiro Shirao, Komatsu, Japan

[73] Assignee: Kabushiki Kaisha Komatsu Seisakusho, Tokyo, Japan

[21] Appl. No.: 615,635

[22] Filed: May 31, 1984

[30] Foreign Application Priority Data

May 31, 1983 [JP] Japan ..... 58-094885
May 31, 1983 [JP] Japan ..... 58-082521[U]
May 31, 1983 [JP] Japan ..... 58-082522[U]

[51] Int. Cl.[4] ..... B30B 15/30

[52] U.S. Cl. ..... 414/752; 198/468.4; 198/468.6; 414/225; 414/917

[58] Field of Search ..... 414/752, 749, 750, 751, 414/733, 917, 222, 225; 198/586, 486, 468.4, 468.6, 468.2

[56] References Cited

U.S. PATENT DOCUMENTS

| | | | |
|---|---|---|---|
| Re. 18,133 | 7/1931 | Westin | 414/733 |
| 2,711,817 | 6/1955 | Hautau et al. | 198/486 X |
| 4,183,427 | 1/1980 | Tomikawa | 414/752 X |
| 4,215,972 | 8/1980 | Yamasaki et al. | 414/719 X |
| 4,411,587 | 10/1983 | Niki | 414/752 |

*Primary Examiner*—Donald W. Underwood

*Attorney, Agent, or Firm*—Armstrong, Nikaido Marmelstein & Kubovcik

[57] ABSTRACT

An automatic press line is disclosed which has a series of presses with a conveyor for transporting a succession of workpieces from one press to the next, and loading-/unloading devices mounted one to each end of each press for loading and unloading the workpieces into and from the press line and for the transfer of the workpieces from press to press via the conveyor. Each loading/unloading device has a carriage to be controllably moved up and down on a support frame. The carriage carries a parallelogram linkage comprising a top link mounted to the carriage for up and down motion relative to the same, a pair of side links extending in a vertical plane, and a bottom link to which there is affixed a work carrier having suction cups. Extending between the carriage and one of the side links, a drive lever is swung back and forth to cause the parallelogram linkage to reciprocate the work carrier in a horizontal direction. The horizontal motion of the bottom link of the parallelogram linkage combines with the up and down motion of the carriage to enable the work carrier to move the successive workpieces into or out of the press. The support frame may be moved transversely of the press line for a change of press dies.

15 Claims, 11 Drawing Figures

30
32
32
48
64
34
78
70
48
78
42
VI
62
56
50
36
40
60
VI
54
58
80
52
92
38
68
112
116
VII
114
100
72
VII
88
96
106
102
110
108
94
98
104
76
90
82

WORKPIECE LOADING/UNLOADING DEVICE FOR A PRESS OR THE LIKE

BACKGROUND OF THE INVENTION

This invention relates to a device for loading and/or unloading workpieces into and/or from a press or the like. The loading/unloading device in accordance with the invention has particular utility in conjunction with an automatic press line, being adaptable both for loading and unloading workpieces into and from the press line and for the transfer of the workpieces from press to press.

In an automatic press line, as is well known, workpieces are fed through a series of spaced apart presses thereby to be progressively turned into desired objects. A variety of apparatus have been suggested and used for the transfer of workpieces from one press to another of a press line. Schneider et al. U.S. Pat. No. 4,279,561 represents an example of such known apparatus. Most of the prior art devices are subject to the objection, however, that they lend themselves to use only for work transfer from one press to another and not for the loading and unloading of work into and from the press line.

SUMMARY OF THE INVENTION

The present invention provides a novel device that can be used both for the loading and/or unloading of workpieces into and/or from a press or like work processing machine and for the transfer of workpieces from press to press in an automatic press line.

Stated in brief, the loading and/or unloading device of this invention includes a support frame to be mounted to a desired work processing machine. The support frame has a carriage mounted thereto which is moved up and down relative to the support frame and, therefore, to the work processing machine by a first drive mechanism. The carriage carries a parallelogram linkage comprising a top link operatively engaged with the carriage for vertical reciprocation relative to the same, a bottom link, and a pair of side links of equal length joining the top and bottom links in a vertical plane. Coupled to the bottom link of the parallelogram linkage is work carrier means capable of releasably holding a workpiece to be loaded into and/or unloaded from the work processing machine. A drive lever having a length equal to half the length of each side link of the parallelogram linkage is pivotally coupled at one end to the carriage and at the other end to the midpoint of one of the side links. A second drive mechanism acts to bidirectionally swing the drive lever through a preassigned angle.

The above swinging motion of the drive lever results in the operation of the parallelogram linkage such that, with its top link traveling up and down relative to the carriage, its bottom link reciprocates linearly in a horizontal direction. This horizontal reciprocation of the bottom link of the parallelogram linkage is combined with the up and down motion of the carriage relative to the support frame to enable the work carrier means coupled to the bottom link to load and/or unload the work processing machine. The horizontal reciprocation of the work carrier means is particularly desirable for the smooth, uniterrupted loading and unloading of generally flat workpieces into and from a press with its dies.

According to a further feature of the invention the support frame together with the various other parts set forth above is mounted to another carriage for movement therewith in a horizontal direction at right angles with the direction of workpiece travel. Such horizontal travel of the loading/unloading device is required as when the machine is to be refurnished or, in the case of a press, when its dies are to be changed.

The invention also features means for adjustably moving the support frame up and down relative to the second recited carriage, in addition to the noted means for moving the support frame horizontally with the second carriage. This feature makes possible the fine adjustment of the vertical position of the loading/unloading device to the particular work processing machine intended for use therewith, adding to the versatility of the device.

In a preferred embodiment the first and second drive mechanisms include servomotors, which are both mounted to the support frame, rather than to the first carriage, and which are mechanically linked to the first carriage to cause respectively the up and down motion of the first carriage and the swinging motion of the drive lever. The first carriage is therefore free from the weight of both servomotors, lessening the load on the servomotor for the vertical movement of the first carriage. The servomotor of the first drive mechanism can be secured to the support frame as it vertically moves the first carriage via a rack and pinion mechanism. However, the servomotor of the second drive mechanism must be displaceable relative to the support frame as this second servomotor is intended to impart bidirectional rotation to the drive lever on the first carriage movable vertically. Thus the second servomotor is made horizontally slidable on the support frame and has its body linked to the first carriage as by turnbuckles, so that torque transmission from the second servomotor to the drive lever is possible in the face of the variable vertical position of the first carriage.

The invention is herein disclosed as adapted for a press line, with a conveyor such as a standard belt conveyor bridging the space between two presses. This application requires the use of a plurality of loading/unloading devices in accordance with the invention, each constructed as in the foregoing and mounted one to each end of each press. The loading/unloading devices function both to load and unload workpieces into and from the press line and, via the conveyor, to transfer the workpieces from one press to the next.

The above and other features and advantages of this invention and the manner of realizing them will become more apparent, and the invention itself will best be understood, from a study of the following description and appended claims taken together with the attached drawings showing the preferred embodiment of the invention.

DESCRIPTION OF THE PREFERRED EMBODIMENT

Figure 1:
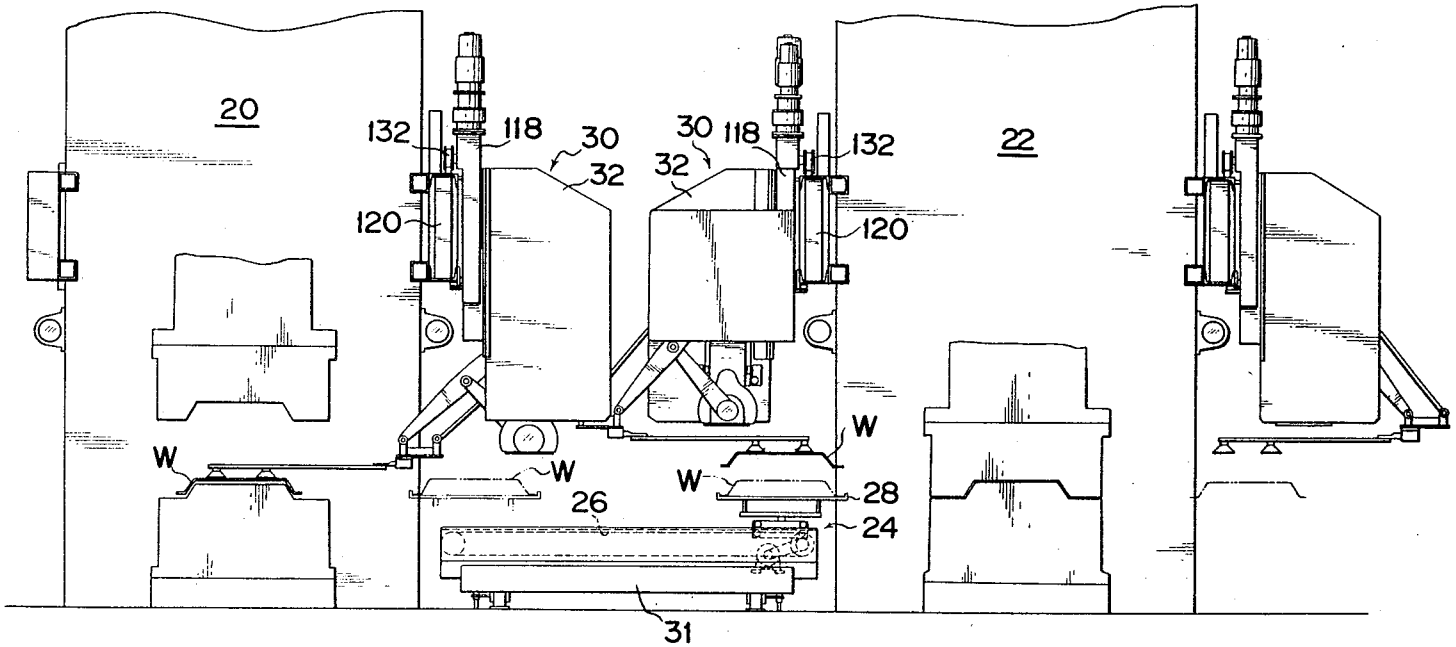
FIG. 1 is a side elevation of an automatic press line constructed in accordance with the novel concepts of this invention, the view showing two presses together with associated loading/unloading devices and transfer conveyor.
Figure 2:
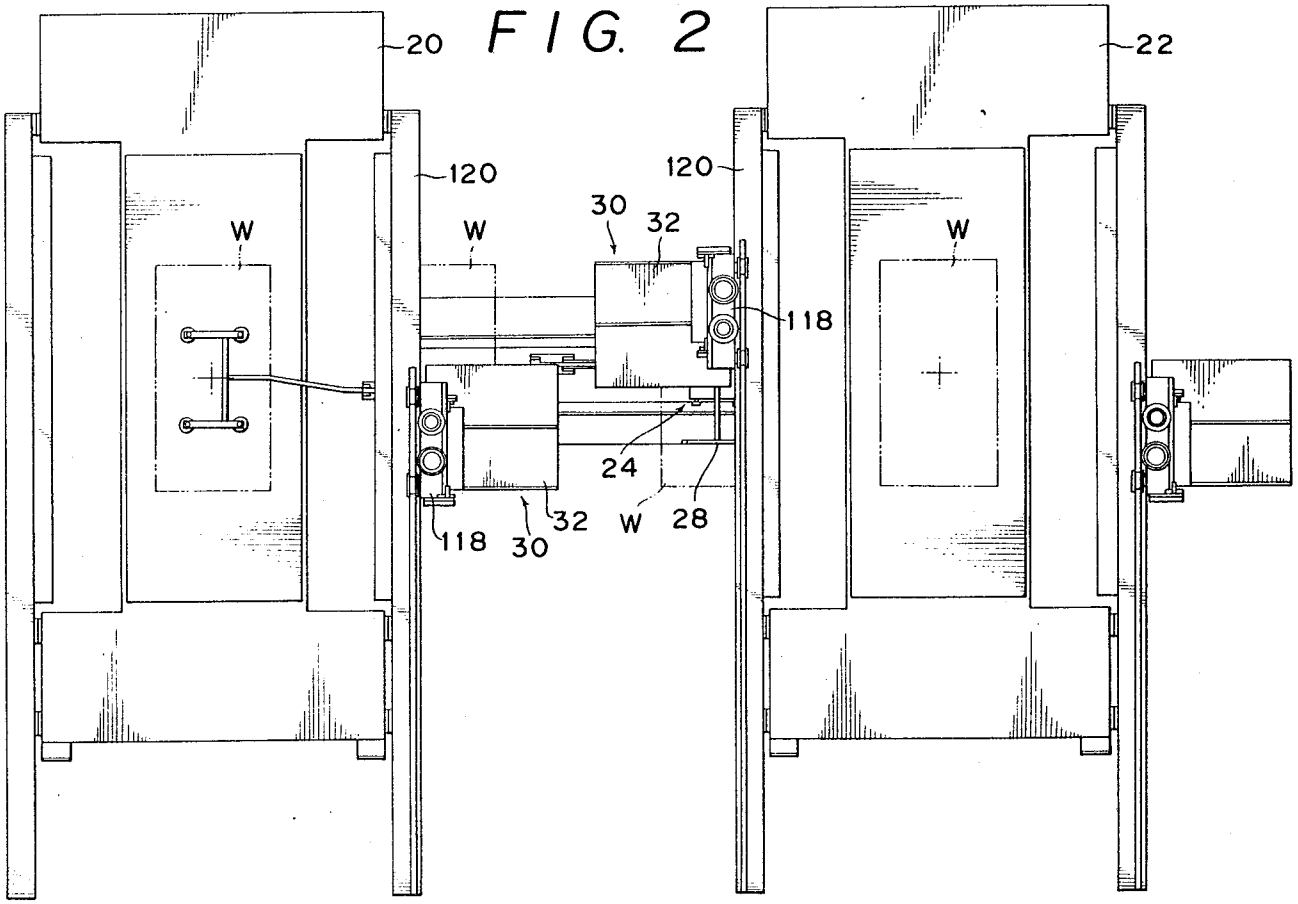
FIG. 2 is a top plan of the automatic press line of FIG. 1.
Figure 3:
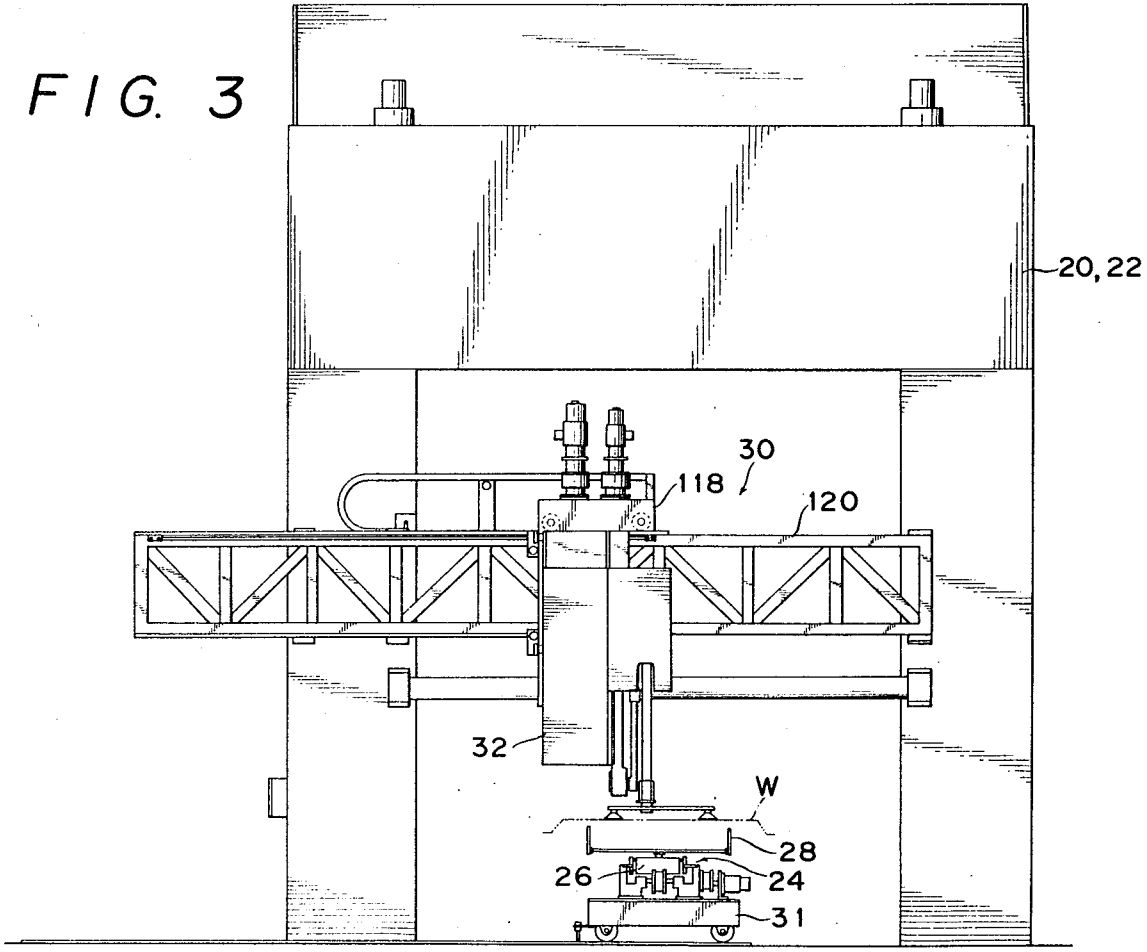
FIG. 3 is an end elevation of one of the presses together with the associated loading/unloading device and transfer conveyor.

With reference first to FIGS. 1 through 3 the automatic press line illustrated therein has two presses 20 and 22 disposed with a spacing therebetween. Bridging the space between the two presses 20 and 22 is a transfer conveyor 24 such as a standard belt conveyor having an endless moving belt 26. A work rest 28 is shown mounted on the conveyor belt 26 for holding thereon a workpiece W for transportation from one press to the other (e.g. from press 20 to press 22).

The reference numeral 30 generally denotes each of two loading/unloading devices herein shown mounted to the opposed ends of the presses 20 and 22. In the illustrated embodiment the left hand one, as seen in FIGS. 1 and 2, of the loading/unloading devices 30 functions to withdraw each workpiece W from the left hand press 20 and to deposit them onto the work rest 28 while the same is being held in the extreme left hand position on the transfer conveyor 24. This conveyor transports the deposited workpiece to the extreme right hand position. Then the right hand loading/unloading device picks up the workpiece from the work rest 28 and introduces it into the right hand press 22. The transfer conveyor 34 may be mounted on a suitable carriage 31 for ready withdrawal from the space between the presses 20 and 22 as required.

The two loading/unloading devices 30 are exactly identical in construction except that they are mounted in opposite directions to the presses 20 and 22. Accordingly the description of one loading/unloading device 30 applies to the other.

FIGS. 4 through 7 illustrate in greater detail one of the loading/unloading devices 30. These figures do not, however, include means for moving the device horizontally and vertically with respect to the press, such means being shown in detail in FIGS. 8 through 11. It will be observed from FIGS. 4 through 7 that the representative loading/unloading device 30 has a generally boxlike support frame or enclosure 32. Mounted externally to the support frame 32 is a vertically elongated carriage 34 having a relatively narrow upper portion 36 and a wider lower portion 38. The narrower upper portion 36 of the carriage 34 has a pair of fins 40 extending vertically on its opposite sides. These fins make rolling engagement with two sets of guide rolls 42 on the support frame 32. The wider lower portion 38 of the carriage 34 has a like pair of fins 44 for rolling engagement with two sets of guide rolls 46 on the support frame 32. Thus the carriage 34 rolls up and down relative to the support frame 32. The guide rolls 42 and 46 are so arranged as to bear the carriage 34 against displacement in any direction other than the vertical. A pair of limit stops 48 on the support frame 32 bound the opposite extremities of the vertical travel of the carriage 34.

The reference numeral 50 in FIGS. 5 and 6 generally denotes a drive mechanism (hereinafter referred to as the vertical drive mechanism) for the vertical displacement of the carriage 34. The vertical drive mechanism 50 includes a bidirectional rotary actuator, preferably a servomotor 52 mounted within and secured to the support frame 32. The servomotor 52 is coupled via a timing belt 54 to a speed reducer 56 also secured to the support frame 32. The speed reducer 56 has a pinion 58 fixedly mounted on its output shaft 60 for positive engagement with an upstanding rack 62 secured to the carriage 34 via a slot 64 in the support frame 32. It is thus seen that the carriage 34 travels up and down with the bidirectional rotation of the servomotor 52.

Figure 4:
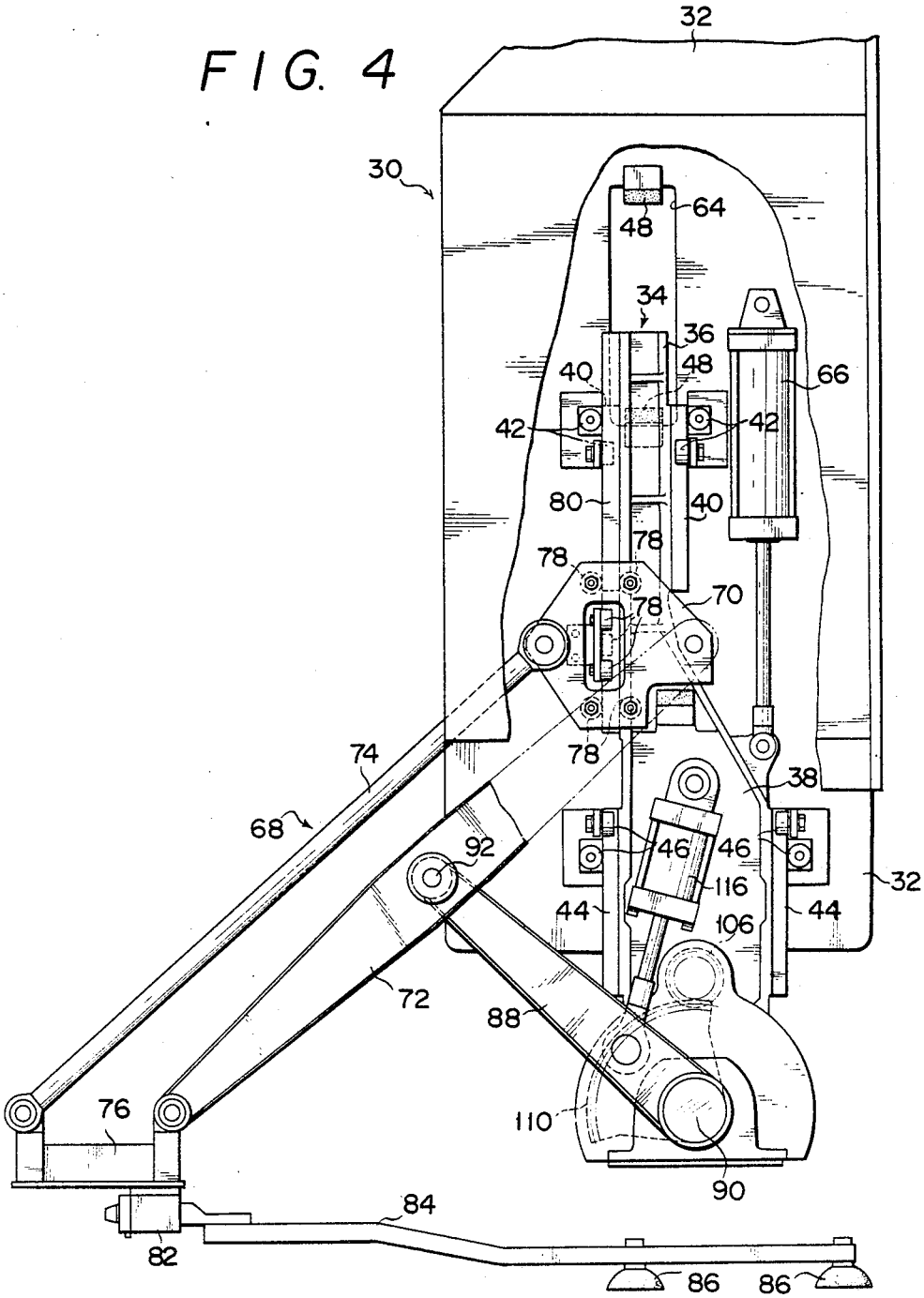
FIG. 4 is an enlarged side elevation, with a part shown broken away to reveal other parts, of the essential parts of one of the loading/unloading devices used in the press line of FIG. 1.

At 66 in FIG. 4 is seen a fluid actuated cylinder operatively connected between support frame 32 and carriage 34. This cylinder acts to counterbalance the load imposed upon the carriage 34 and hence to lessen the burden on the servomotor 52.

Figure 5:
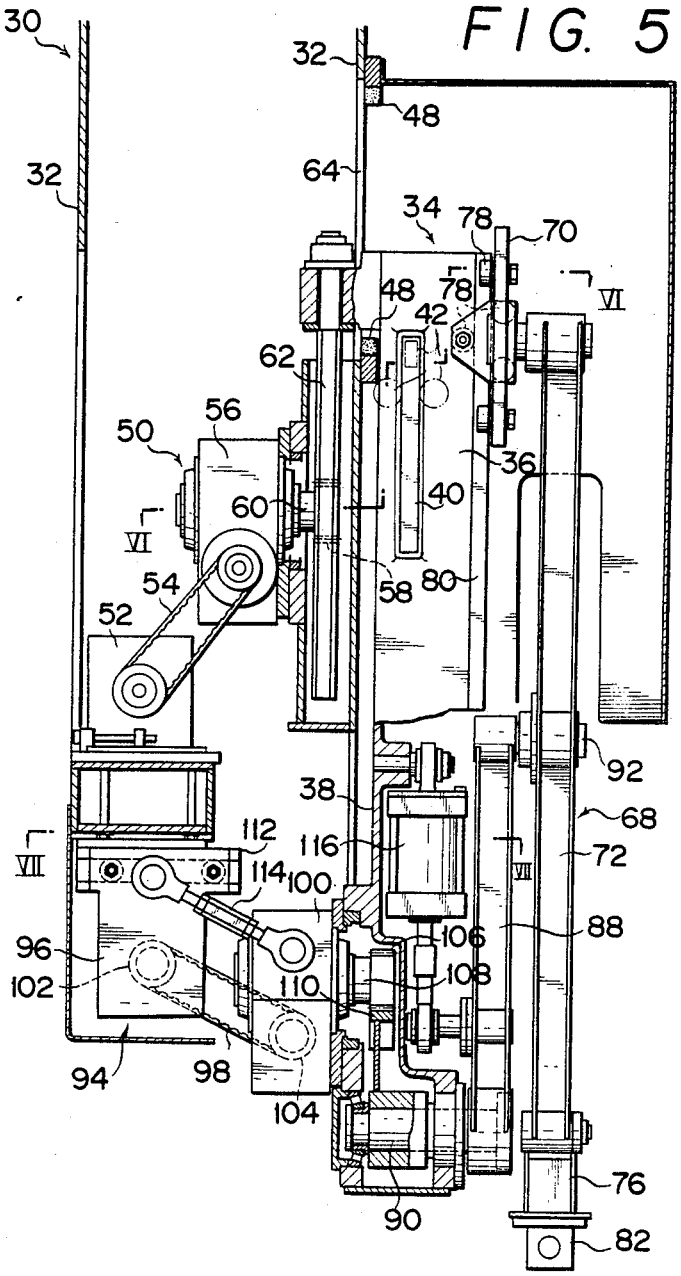
FIG. 5 is a vertical section through the means shown in FIG. 4.
Figure 6:
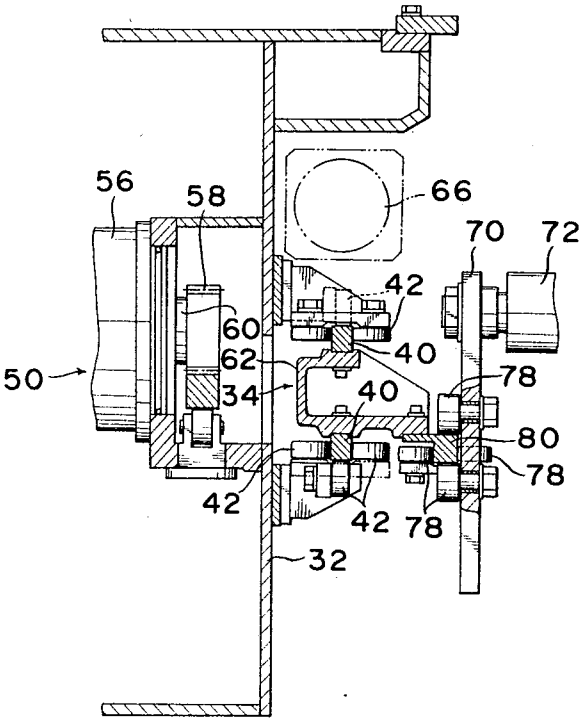
FIG. 6 is a horizontal section taken along the line VI—VI of FIG. 5.

Mounted to the carriage 34 is a parallelogram linkage 68 shown also in FIGS. 4 and 5. The parallelogram linkage 68 comprises a top link 70, a pair of side links 72 and 74, and a bottom link 76. As will be seen also from FIG. 6, the top link 70 is shown as a flat plate of polygonal shape, having a plurality of rollers 78 for rolling engagement with a guide rail 80 extending vertically on the carriage 34. Accordingly the top link 70 rolls up and down along the guide rail 80 with respect to the carriage 34. The arrangement of the rollers 78 in relation to the guide rail 78 is also well calculated to restrain the top link 70 from displacement in any direction other than the vertical.

The pair of side links 72 and 74 of the parallelogram linkage 68 are of the same length and extend in a vertical plane in parallel spaced relationship to each other. The top ends of the side links 72 and 74 are pivotally coupled to the top link 70 in positions spaced apart in a horizontal direction or in the longitudinal direction of the press line. The bottom ends of the side links 72 and 74 are pivotally coupled to the bottom link 76, also in positions thereon spaced apart horizontally in the longitudinal direction of the press line.

Affixed to the underside of the bottom link 76 via a holder 82 is a work carrier 84 for releasably holding and carrying each workpiece W to be loaded into or unloaded from the press 20 or 22. The work carrier 84 of this particular embodiment has a plurality of suction cups 86 directed downwardly for causing adhesion of each workpiece W thereto by suction. The work carrier 84 with its suction cups 86 is to be moved vertically with the carriage 34 by the vertical drive mechanism 50, and horizontally by the parallelogram linkage 68 having its own actuating means set forth hereafter.

As shown in both FIGS. 4 and 5, a drive lever 88 is employed for pivoting the pair of side links 72 and 74 of the parallelogram linkage 68 about their axes on the top link 70. One end of the drive lever 88 is rigidly coupled to a spindle 90 which is rotatably mounted on the bottom end of the carriage 34 so as to extend normal to the plane of the parallelogram linkage 68. The other end of the drive lever is pivotally coupled at 92 to the midpoint of the side link 72 of the parallelogram linkage 68. The drive lever 88 has a length equal to half the length of each side link 72 or 74 of the parallelogram linkage 68. Consequently, with the oscillation of the drive lever 88 about the spindle 90, the pair of side links 72 and 74 of the parallelogram linkage 68 swing back and forth in a vertical plane, with its top link 70 rolling up and down on the carriage 34, to cause the desired horizontal reciprocation of the work carrier 84.

Figure 7:
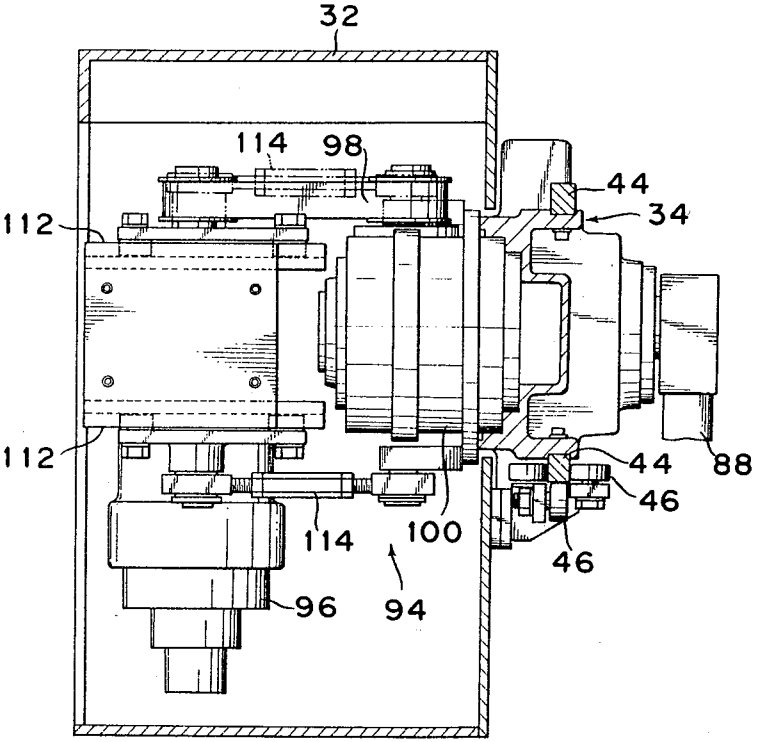
FIG. 7 is a horizontal section taken along the line VII—VII of FIG. 5.

Generally designated 94 in FIGS. 5 and 7 is a drive mechanism for bidirectionally pivoting the drive lever 88 about the spindle 90 and hence for causing the parallelogram linkage 68 to horizontally reciprocate the work carrier 84. This second drive mechanism 94 will be hereinafter referred to as the horizontal drive mechanism in contradistinction to the vertical drive mechanism 50.

The horizontal drive mechanism 94 includes a bidirectional rotary actuator such as a servomotor 96 mounted to the support frame 32. A drive linkage such as a timing belt 98 connects the servomotor 96 to a speed reducer 100 secured to the lower portion 38 of the carriage 34. The pulleys 102 and 104 around which the timing belt 98 extends are of the same diameter. The speed reducer 100 has a pinion 106 fixedly mounted on its output shaft 108. This pinion meshes with a sector gear 110 which rotates bidirectionally through a preassigned angle with the spindle 90 in a coaxial relation therewith. Thus the drive lever 88 swings back and forth about the spindle 90 as the bidirectional rotation of the servomotor 96 is transmitted thereto via the timing belt 98, speed reducer 100, and intermeshing gears 106 and 110. A problem arises, however, as the servomotor 96 is mounted to the support frame 32 and as the drive lever 88 travels up and down with the carriage 34 relative to the support frame. Torque transmission from servomotor 96 to drive lever 88 must take place properly in spite of the vertical displacement of the carriage.

A solution to the above problem is the slidable or rollable mounting of the servomotor 96 to the support frame 32 for displacement in a horizontal direction normal to the plane of the carriage 34 and of the parallelogram linkage 68. In the illustrated embodiment the servomotor 96 is movable along a pair of guides 112 secured to the support frame 32. A pair of turnbuckles 114 or like link means operately interconnect the body of the servomotor 96 and that of the speed reducer 100 so as to cause horizontal displacement of the servomotor with the vertical motion of the carriage 34.

Although the electrical details of this and other loading/unloading devices 30 are not illustrated, it is understood that the servomotor 52 of the vertical drive mechanism 50 and the servomotor 96 of the horizontal drive mechanism 94 are under the control of separate closed path numerical controls (CNCs). The vertical and horizontal strokes of the work carrier 84 are therefore variable independently of each other.

A fluid actuated cylinder 116 is operatively connected between carriage 34 and drive lever 88 for counterbalancing the load to be exerted on the latter during work transfer. This cylinder serves to lessen the load on the servomotor 96.

With reference back to FIGS. 1 through 3 the support frame 32 of each loading/unloading device 30 is mounted to a wheeled, self propelled carriage 118 for movement therewith along a guide track 120 on the associated press 20 or 22. The guide track 120 extends horizontally and at right angles with the direction of workpiece travel. The complete device of FIGS. 4 through 7 is movable along the guide track 120 and is further movable up and down relative to the self propelled carriage 118, as discussed in further detail hereinbelow.

As illustrated in detail in FIGS. 8 through 11, the guide track 120 is provided by an elongate guide frame 122 secured to the press 20 or 22. A guide rail 124 extends along the top edge of the guide frame 122, and another guide rail 126 along its bottom edge. Movable along this guide track, the carriage 118 has an upper, horizontally elongated boxlike portion 128 and a lower, vertically elongated boxlike portion 130. The upper carriage portion 128 has a pair of wheels 132 overlying the upper guide rail 124 in rolling engagement therewith. The lower carriage portion 130 has two pairs of guide rolls 134 disposed on the opposite sides of the lower guide rail 126 and making rolling engagement therewith so as to prevent displacement of the carriage 118 in a direction at right angles with the guide track 120. The guide frame 122 has a chain 136 affixed to its front face so as to extend horizontally. In engagement with this chain is a sprocket 138 housed in the lower carriage portion 130 and partly projecting rearwardly therefrom. A bidirectional propelling motor 140 on the upper carriage portion 128 is coupled in driving relationship to the sprocket 138 via a speed reducer 142. Thus, with the bidirectional rotation of the propelling motor 140, the carriage 118 travels back and forth along the guide track 120.

The support frame 32 of each loading/unloading device 30 is mounted to the carriage 118 for vertical displacement. It will be observed from FIGS. 8 and 11 that the support frame 32 has a pair of rims 144 extending vertically along the opposite sides of its rear end. Each rim 144 is in rolling engagement with two sets of vertically spaced apart guide rolls 146 on the carriage 118. The guide rolls 146 are so arranged as to allow the vertical travel of the support frame 32 but to restrain the same from displacement in any other direction.

Employed for the vertical travel of the support frame 32 is a worm 148 rotatably housed in the lower carriage portion 130 and engaged with a nut 150 sleeved thereon. The nut 150 is secured to the support frame 32 via a bracket 152 projecting out of the lower carriage portion 130 through an opening 154 therein. The worm 148 is coupled via a speed reducer 156 to a bidirectional height adjustment motor 158 mounted on the upper carriage portion 128 in side by side relationship with the propelling motor 140. The bidirectional rotation of the height adjustment motor 158 results in the up and down motion of the support frame 32 relative to the carriage 118. The worm 148 has a downward extension 160 coupled to a vertical position sensor 162 via reduction gearing 164. A pair of limit switches 166 are mounted within the lower carriage portion 130 for activation by a switch actuator 168 on the bracket 152 in the extreme positions of the vertical travel of the support frame 32.

Figure 11:
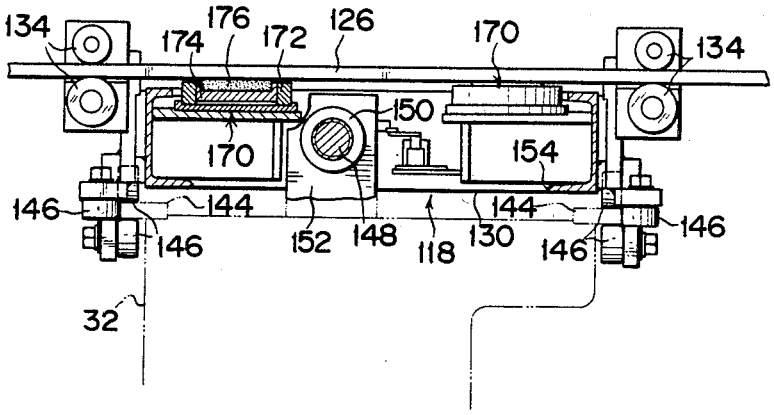
FIG. 11 is a horizontal section taken along the line XI—XI of FIG. 9.

The self propelled carriage 118 is further provided with a pair of brakes 170 best seen in FIG. 11. Each brake 170 has an air cylinder 172 rigidly supported by the lower carriage portion 130. The cylinder 172 has a ram 174 slidaby fitted therein for movement into frictional engagement with the lower guide rail 126 on the guide frame 122 under air pressure. The ram 174 may be provided with a lining of any suitable material as at 176.

OPERATION

The left hand loading/unloading device 30 of FIG. 1 operates to unload the workpiece W that has been processed by the left hand press 20. For the withdrawal of the workpiece W the work carrier 84 may be placed over the workpiece in the press 20 by turning the drive lever 88 in a clockwise direction, as viewed in FIG. 1, by the horizontal drive mechanism 94, with the carriage 34 raised by the vertical drive mechanism 50. Then the carriage 34 is lowered by the vertical drive mechanism 50 to press the suction cups 86 on the underside of the work carrier 84 against the workpiece W to cause adhesion thereof. Then the work carrier 84 together with the workpiece W is raised by the vertical drive mechanism 50 and subsequently moved horizontally downstream by the horizontal drive mechanism 94 until the workpiece comes to a predetermined position just over the work rest 28 on the upstream end of the transfer conveyor 24. Released from the suction cups 86 in this position, the workpiece W is deposited on the work rest 28, thereby to be carried to the downstream end of the transfer conveyor 24.

The right hand loading/unloading device 30 of FIG. 1 operates in essentially the same manner to pick up the workpiece W from the work rest 28 and to load the same into the next press 22. It will be seen, then, that each loading/unloading device 30 finds use not only for the transfer of workpieces from press to press but also for the loading and unloading of the workpieces into and from the complete press line.

Particular attention is called to the operation of the carriage 34 and parallelogram linkage 68, together with the associated vertical drive mechanism 50 and horizontal drive mechanism 94, of each loading/unloading device 30. As the carriage 34 travels up and down, the servomotor 96 of the horizontal drive mechanism 94 reciprocates horizontally, being coupled to the carriage via the turnbuckles 114. Thus the working length of the timing belt 98 connecting the servomotor 96 and the speed reducer 100 remain unchanged. It will also be appreciated that the parallelogram linkage 68 with its drive lever 88 is well designed to make possible the desired horizontal travel of the work carrier 84.

Figure 8:
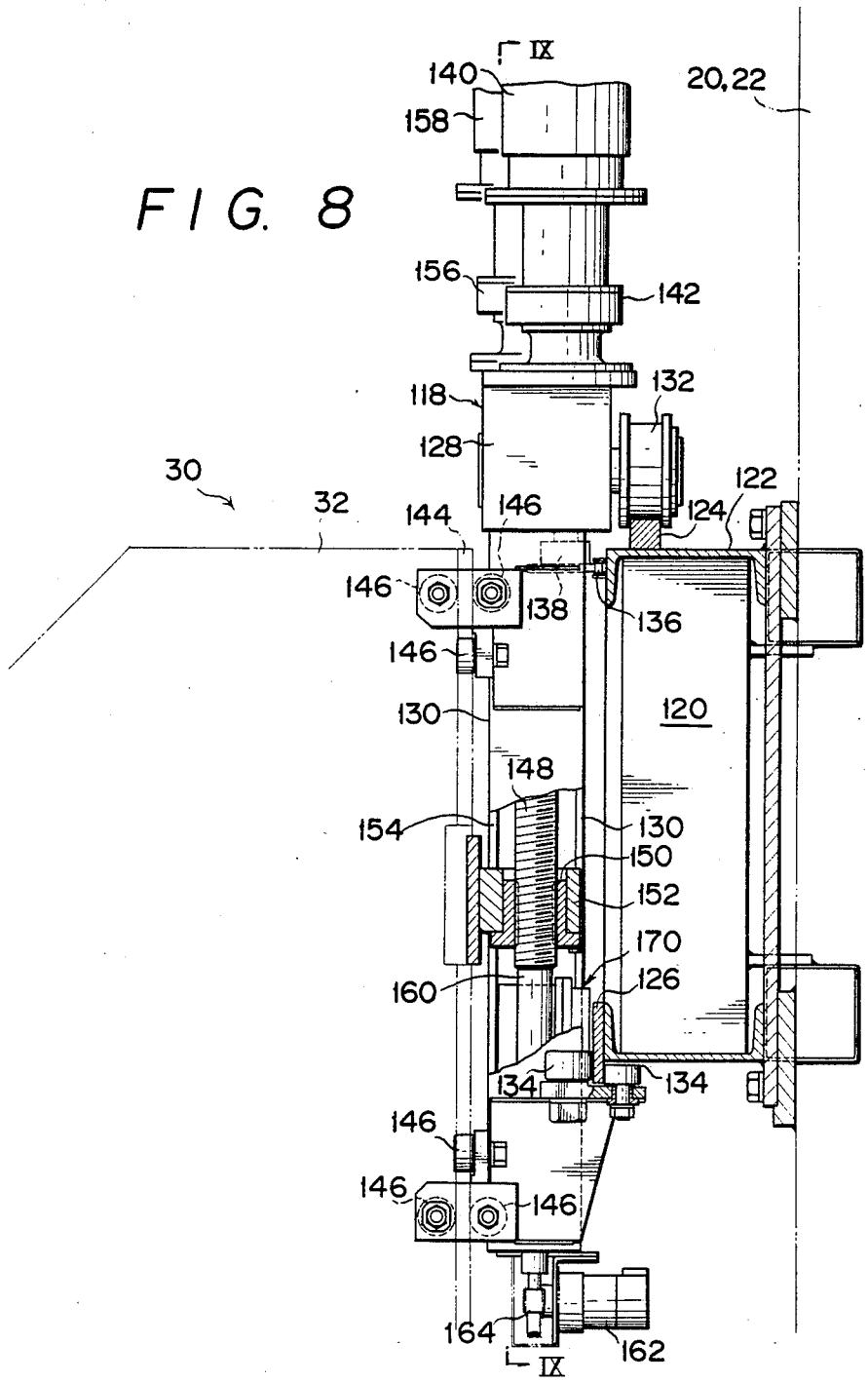
FIG. 8 is an enlarged elevation, partly in section and with a part shown broken away to reveal other parts, of the carriage and supporting means which may be considered parts of each loading/unloading device used in the press line of FIG. 1.
Figure 9:
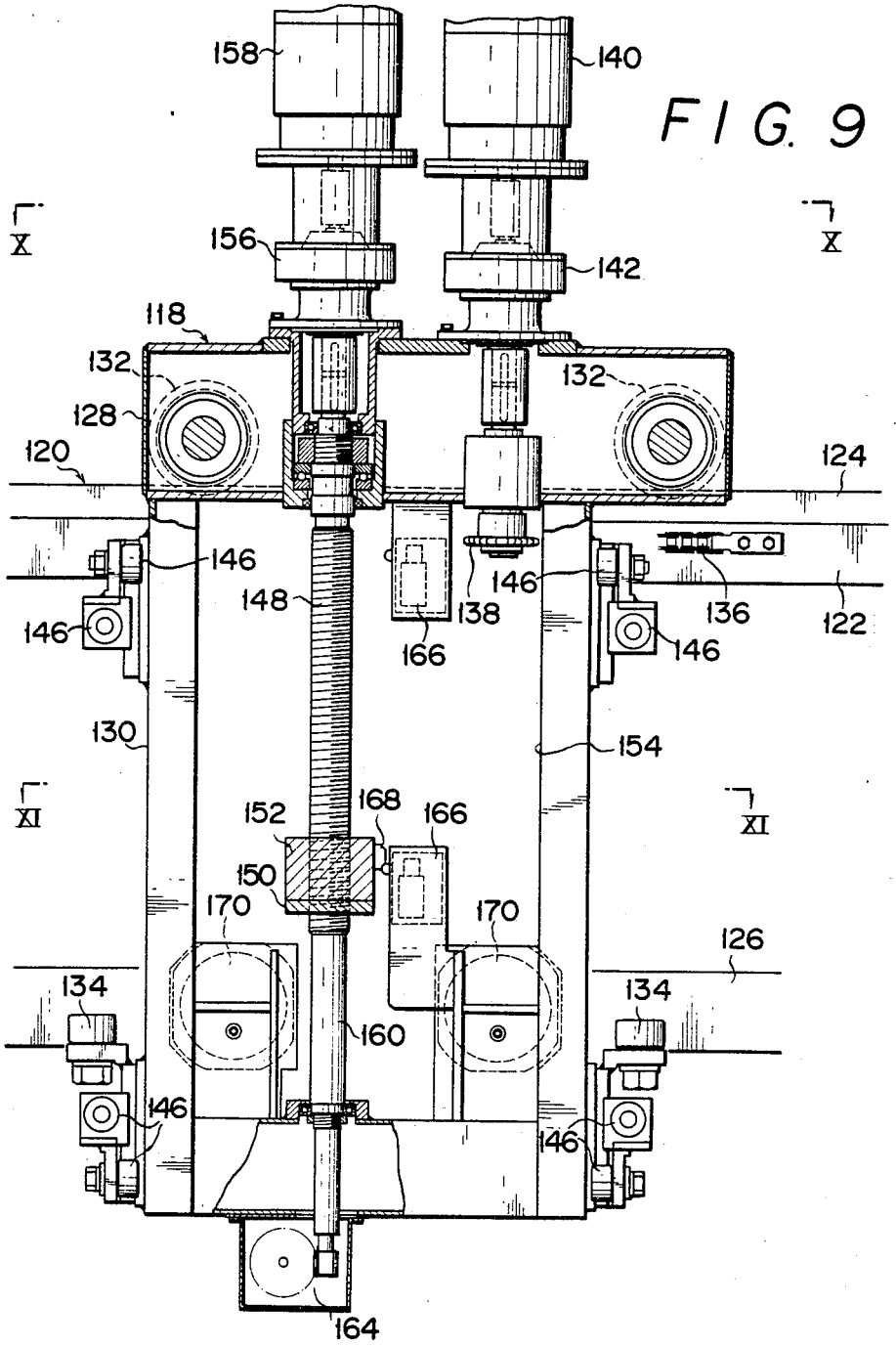
FIG. 9 is a vertical section taken along the line IX—IX of FIG. 8.
Figure 10:
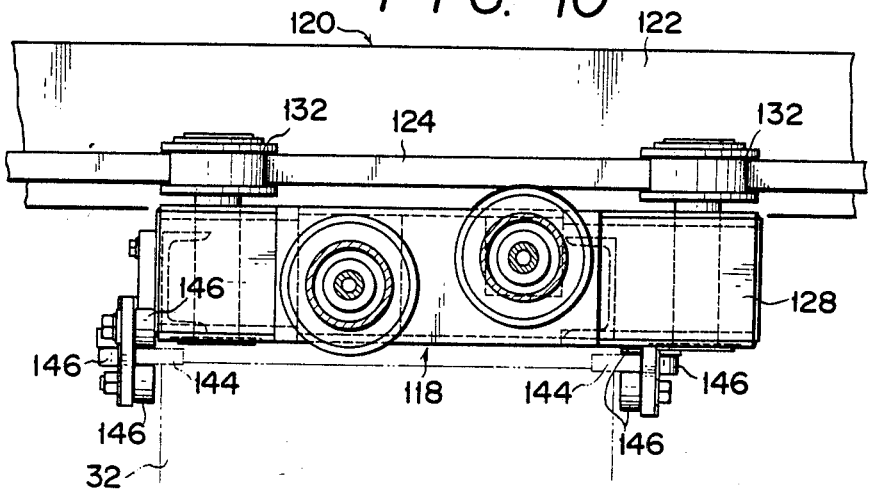
FIG. 10 is a horizontal section taken along the line X—X of FIG. 9.

The vertical position of the support frame 32 of each loading/unloading device 30 is adjustable to the associated press 20 or 22 by the height adjustment motor 158, as will be apparent from a consideration of FIGS. 8 and 9. The support frame 32 moves vertically relative to the self propelled carriage 118.

Further the support frame 32 is movable with the carriage 118 along the horizontal guide track 120 as the carriage is self propelled with its motor driven sprocket 138 in engagement with the fixed chain 136. The brakes 170 lock the carriage 118 against accidental displacement in any desired position on the guide track 120. The loading/unloading device 30 may thus be readily retracted from its working position for a die change or other purposes.

Notwithstanding the above detailed disclosure it is to be understood that this embodiment represents but one possible application of the present invention. Additional applications of the invention, then, as well as modifications or alterations of the construction disclosed herein, may be resorted to without departing from the spirit or scope of the invention as expressed in the following claims.

What is claimed is:

1. A device for loading and/or unloading workpieces into and/or from a press or like work processing machine, comprising:

(a) a support frame adapted to be mounted to a desired work processing machine;

(b) a carriage mounted to the support frame for up and down motion relative to the same;

(c) a first drive mechanism for controllably moving the carriage up and down relative to the support frame;

(d) a parallelogram linkage comprising:

(1) a top link mounted to the carriage for up and down motion relative to the same;

(2) a bottom link; and (3) a pair of side links of the same length extending in a vertical plane and in parallel spaced relationship to each other and pivotally connected each at one end to the top link in horizontally spaced apart positions thereon;

(e) work carrier means coupled to the bottom link of the parallelogram linkage for releasably holding a workpiece to be loaded into and/or unloaded from the work processing machine;

(f) a drive lever having a length equal to half the length of each side link of the parallelogram linkage and pivotally coupled at one end to the carriage and at the other end to the midpoint of one of the side links of the parallelogram linkage; and (g) a second drive mechanism for bidirectionally pivoting the drive lever relative to the carriage to cause the parallelogram linkage to reciprocate the work carrier means in a horizontal direction, said second drive mechanism comprises:

(1) a bidirectional rotary actuator mounted to the support frame for displacement in a horizontal direction;

(2) drive means on the carriage for causing the bidirectional pivotal motion of the drive lever in response to the bidirectional rotation of the rotary actuator;

(3) a drive linkage for transmitting the bidirectional rotation of the rotary actuator to the drive means so as to allow the up and down motion of the carriage relative to the support frame; and (4) link means operatively interconnecting the carriage and the rotary actuator so as to cause the horizontal displacement of the latter relative to the support frame with the up and down motion of the carriage.

2. The workpiece loading and/or unloading device as recited in claim 1, wherein the first drive mechanism comprises:

(a) a bidirectional rotary actuator on the support frame; and (b) a rotary to linear conversion mechanism for translating the bidirectional rotation of the rotary actuator into the linear up and down motion of the carriage.

3. The workpiece loading and/or unloading device as recited in claim 2, wherein the rotary actuator is a servomotor.

4. The workpiece loading and/or unloading device as recited in claim 2, wherein the rotary to linear conversion mechanism comprises:

(a) a pinion on the support frame adapted to be driven from the rotary actuator; and
(b) a rack mounted to the carriage and meshing with the pinion.

5. The workpiece loading and/or unloading device as recited in claim 1, wherein the rotary actuator is a servomotor.

6. The workpiece loading and/or unloading device as recited in claim 1, wherein the drive linkage comprises a timing belt.

7. The workpiece loading and/or unloading device as recited in claim 1, wherein the link means comprises a pair of turnbuckles.

8. The workpiece loading and/or unloading device as recited in claim 1, further comprising a fluid actuated cylinder operatively connected between the support frame and the carriage for counterbalancing the load exerted on the carriage.

9. The workpiece loading and/or unloading device as recited in claim 1, further comprising a fluid actuated cylinder operatively connected between the carriage and the drive lever for counterbalancing the load exerted on the drive lever.

10. The workpiece loading and/or unloading device as recited in claim 1, further comprising :
(a) guide means adapted to be mounted to the work processing machine so as to extend horizontally and at right angles with the direction in which the workpieces are to be loaded into and/or unloaded from the machine;
(b) a second carriage having the support frame mounted thereto and movable therewith along the guide means; and
(c) a propelling mechanism for reciprocably moving the second carriage along the guide means.

11. The workpiece loading and/or unloading device as recited in claim 10, wherein the propelling mechanism is built into the second carriage so that the latter is self propelled for movement along the guide means.

12. The workpiece loading and/or unloading device as recited in claim 11, further comprising brake means acting between the second carriage and the guide means for locking the second carriage against movement in a desired position on the guide means.

13. The workpiece loading and/or unloading device as recited in claim 10, wherein the support frame is mounted to the second carriage for up and down motion relative to the same, and wherein the device further comprises means for adjustably moving the support frame up and down relative to the second carriage.

14. An automatic press line series of presses for successively processing workpieces, a conveyor for transporting the workpieces from one press to the next, and a plurality of loading/unloading devices mounted one to each end of each press for loading and unloading the workpieces into and from the press line and for the transfer of the workpieces from one press to the next via the conveyor, each loading/unloading device comprising:
(a) guide means on one press extending transversely of the press line;
(b) a first carriage movable along the guide means;
(c) a support frame mounted to the first carriage for movement therewith along the guide means;
(d) a second carriage mounted to the support frame for up and down motion relative to the same;
(e) a first drive mechanism for controllably moving the second carriage up and down relative to the support frame;
(f) a parallelogram linkage comprising:
(1) a top link mounted to the second carriage for up and down motion relative to the same;
(2) a bottom link; and
(3) a pair of side links of the same length extending in a vertical plane and in parallel spaced relationship to each other and pivotally connected each at one end to the top link in horizontally spaced apart positions thereon and at the other end to the bottom link in horizontally spaced apart positions thereon;
(g) work carrier means coupled to the bottom link of the parallelogram linkage for releasably holding a workpiece to be loaded into or unloaded form the press;
(h) a drive lever having a length equal to half the length of each side link of the parallelogram linkage and pivotally coupled at one end to the second carriage and at the other end to the midpoint of one of the side links of the parallelogram linkage; and
(i) a second drive mechanism for bidirectionally pivoting the drive lever relative to the second carriage to cause the parallelogram linkage to reciprocate the work carrier means in a horizontal direction, said second drive mechanism comprises:
(1) a bidirectional rotary actuator mounted to the support frame for displacement in a horizontal direction;
(2) drive means on the carriage for causing the bidirectional pivotal motion of the drive lever in response to the bidirectional rotation of the rotary actuator;
(3) a drive linkage for transmitting the bidirectional rotation of the rotary actuator to the drive means so as to allow the up and down motion of the carriage relative to the support frame; and
(4) link means operatively interconnecting the carriage and the rotary actuator so as to cause the horizontal displacement of the latter relative to the support frame with the up and down motion of the carriage.

15. The automatic press line as recited in claim 14, wherein each loading/unloading device further comprises means for adjustably moving the support frame up and down relative to the first carriage.

* * * * *